US007087872B1

(12) United States Patent
Dobie et al.

(10) Patent No.: US 7,087,872 B1
(45) Date of Patent: Aug. 8, 2006

(54) MULTI-SHELVED CONVECTION MICROWAVE OVEN

(75) Inventors: Michael J. Dobie, Double Oak, TX (US); John Robert Norris, Plano, TX (US); Neal S. Cooper, North Richland Hills, TX (US); Carlos Bacigalupe, Carrolton, TX (US); Robert W. Foreman, Euless, TX (US)

(73) Assignee: Enersyst Development Center, L.L.C., Dallas, TX (US)

( * ) Notice: Subject to any disclaimer, the term of this patent is extended or adjusted under 35 U.S.C. 154(b) by 0 days.

(21) Appl. No.: 09/959,178

(22) PCT Filed: Apr. 19, 2000

(86) PCT No.: PCT/US00/10624

§ 371 (c)(1),
(2), (4) Date: Jan. 25, 2002

(87) PCT Pub. No.: WO00/64219

PCT Pub. Date: Oct. 26, 2000

Related U.S. Application Data

(60) Provisional application No. 60/130,067, filed on Apr. 19, 1999.

(51) Int. Cl.
*H05B 6/70* (2006.01)
*H05B 6/80* (2006.01)

(52) U.S. Cl. ..... 219/681; 219/685; 219/746; 219/756; 219/763; 219/401

(58) Field of Classification Search ..... 219/681, 219/685, 746, 748, 756, 763, 400, 401; 126/21 A
See application file for complete search history.

(56) References Cited

U.S. PATENT DOCUMENTS

| | | | | | |
|---|---|---|---|---|---|
| 2,704,802 | A | * | 3/1955 | Blass et al. | 219/746 |
| 3,428,772 | A | * | 2/1969 | Wallenfels | 219/746 |
| 3,692,968 | A | * | 9/1972 | Yasuoka | 219/681 |
| 4,374,319 | A | * | 2/1983 | Guibert | 219/400 |
| 4,455,478 | A | * | 6/1984 | Guibert | 219/400 |
| 4,480,164 | A | * | 10/1984 | Dills | 219/681 |
| 4,691,088 | A | | 9/1987 | Eke | 219/10.55 F |
| 4,972,824 | A | * | 11/1990 | Luebke et al. | 126/21 A |
| 6,060,701 | A | * | 5/2000 | McKee et al. | 219/681 |

FOREIGN PATENT DOCUMENTS

| | | | | |
|---|---|---|---|---|
| EP | 0 429 822 A1 | | 6/1991 | |
| JP | 53-72245 | * | 6/1978 | 219/746 |
| JP | 56119425 A | | 9/1981 | |
| WO | WO 94/16606 A1 | | 8/1994 | |

* cited by examiner

*Primary Examiner*—Philip H. Leung

(57) ABSTRACT

An oven, is provided that includes multiple heat transfer means, including convection and microwave heat transfer means. The oven includes a cooking chamber, a blower and at least a shelf disposed within the cooking chamber. The shelf is designed to act as a food support as well as a conduit through which heated air passes into the cooking chamber. The microwave heating means comprises a microwave source and wave guide through which microwaves travel. The wave guide includes a plurality of openings through which microwaves can pass into said cooking chamber. In the preferred embodiment, the openings in the wave guide are positioned to correspond with the predetermined minima or maxima for the microwave wavelength propagating within the wave guide. An electric heating element may also be disposed within the cooking chamber to provide an alternative heating source.

15 Claims, 16 Drawing Sheets

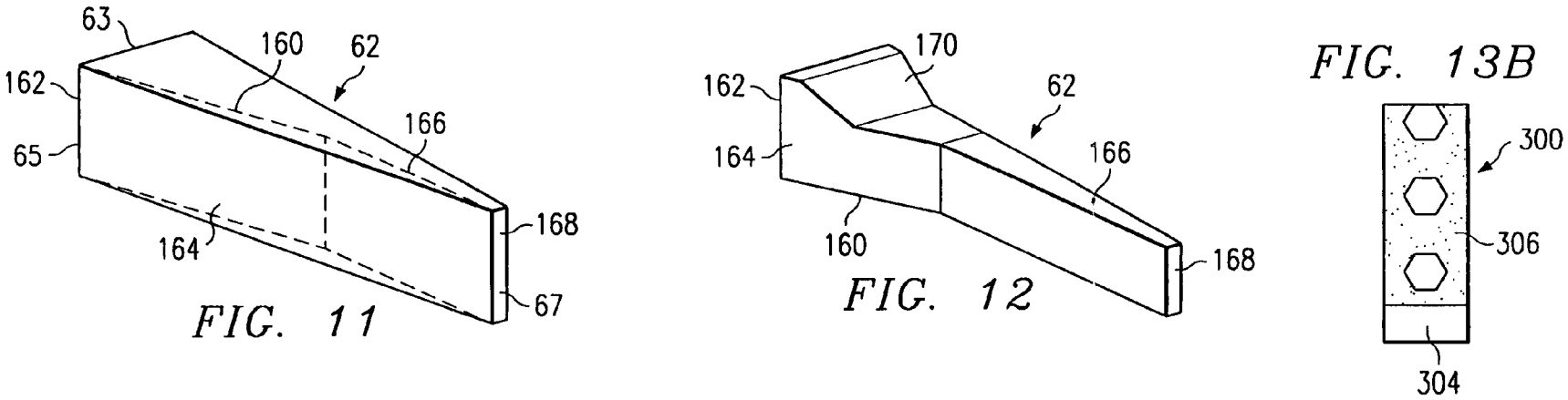
FIG. 13B
FIG. 12
FIG. 11
FIG. 13A
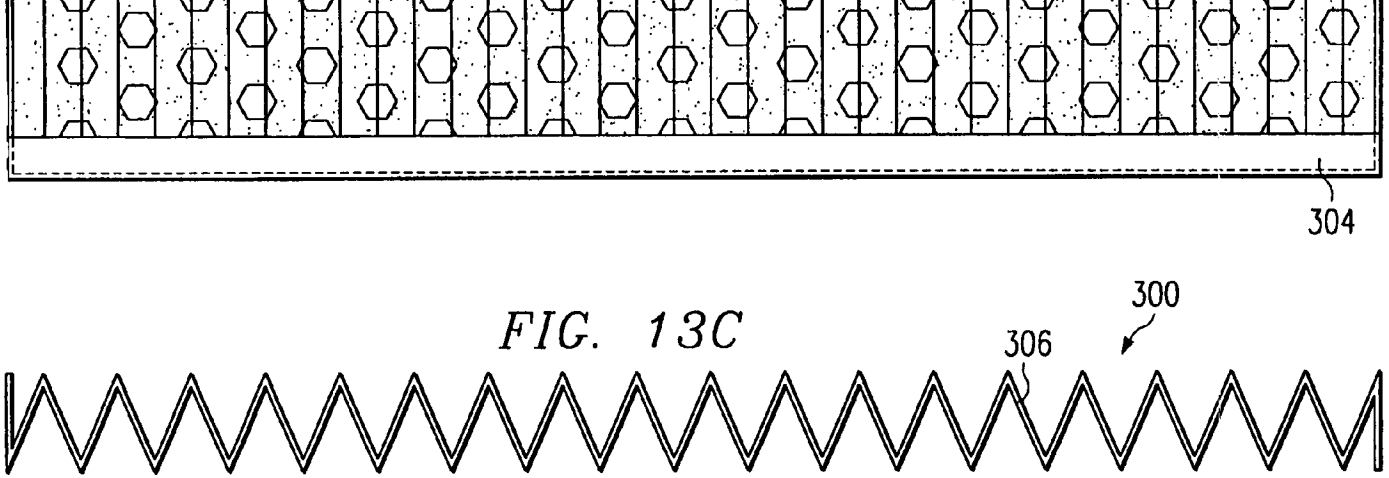
FIG. 13C
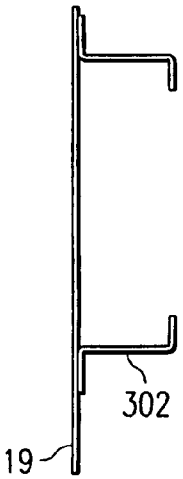
FIG. 14

MULTI-SHELVED CONVECTION MICROWAVE OVEN

CROSS-REFERENCE TO RELATED APPLICATION

This application is related to U.S. Provisional Patent Application Ser. No. 60/130,067 filed Apr. 19, 1999, the entire contents of which are incorporated herein by reference.

FIELD OF THE INVENTION

The present invention relates to a multi-shelved oven having multiple heating means, including convection, microwave and radiant food heating means.

BACKGROUND OF THE INVENTION

The oven disclosed herein relates primarily to ovens suitable for use in the commercial food service industry, such as fast food restaurants, and other food service application where there is great variety in the food products prepared, the need for speedy thermalization of food and space constraints. While various oven designs are known and available for commercial food service applications, there still exists a need for an efficient and effective oven that allows for simultaneous cooking of different food products requiring different heat treatments. Single cavity ovens have been designed heretofore that include microwave and convection heat transfer cooking means. While such ovens meet the needs of certain commercial food service applications by providing rapid thermalization and cooking, the inability to cook different foods simultaneously with different heating conditions and cook cycles does not provide needed flexibility. Furthermore, known combination ovens often require mechanical means to stir the microwave or move the food product in order to achieve even microwave heat transfer to the food product.

The present invention provides an oven that meets a need in the food service industry for an oven provides rapid heating/cooking and the ability to cook multiple food products simultaneously under different conditions and cook cycles. Moreover, the ovens of the present invention provide a microwave heating means that does not require mechanical stirring of microwaves or movement of food products to achieve substantially uniform distribution of microwave energy into the cooking cavities of the oven.

SUMMARY OF THE INVENTION

The present invention provides a novel thermal food treatment system that combines multiple means of heating in a single system.

In one aspect of the invention an oven is provided that includes a cooking chamber, a blower and a shelf disposed within the cooking chamber. The shelf has a unique design in that it has an inlet opening and cavity in fluid communication with the blower and at least one opening in fluid communication with the cooking chamber through which temperature controlled air can flow into the cooking chamber to cook food by convection heating. In another aspect of the invention, the oven further comprises a microwave heating source for heating food products within said cooking chamber, thereby providing multiple heating methods (convection and microwave).

In another aspect of the invention, the microwave heating means includes a microwave source and wave guide through which microwaves travel. The wave guide includes a plurality of openings through which microwaves can pass into said cooking chamber. In a preferred aspect of the invention, the openings in the wave guide are positioned to correspond with the predetermined minima or maxima for the microwave wavelength propagating within the wave guide. That is the spacing of the wave guide openings occurs at multiples of predetermined minima and/or maxima for the microwaves within the guide generated by the microwave source, most commonly a magnetron.

In another aspect of the invention, a heating element can be mounted within the cooking chamber, providing an additional heating means. In a preferred embodiment, a movable, reflective stirrer is positioned above the heating element to reflect heat from the heating element toward a food product.

In yet another aspect of the invention the shelf includes a plurality of louvers protruding from the top surface of the shelf for supporting a food receptacle thereby allowing air to flow freely beneath the food product or receptacle. The louvers have openings that direct temperature controlled air in a direction substantially parallel to the top of the shelf.

In a preferred embodiment of the invention, the cooking chamber comprises a first cooking cavity and a second cooking cavity and includes a first shelf and a second shelf. The first shelf has an inlet opening and cavity in fluid communication with a blower and the second shelf has an inlet opening and cavity in fluid communication with a blower. Further, both the first and second shelves have at least one opening in fluid communication with the first cooking cavity and second shelf having at least one opening in fluid communication with said second cooking cavity, respectively. In a preferred aspect of this embodiment, microwave heating is provided in the first and second cavities through wave guides, preferably a pair of wave guides associated with each cavity. The preferred wave guide arrangement again provides a wave guide having a predetermined minima and maxima and openings in the wave guide positioned to substantially correspond the minima or maxima, thereby providing efficient and even distribution of microwave energy into the cooking cavities along the length of the wave guide.

In yet another aspect of the invention, the blower which supplies temperature controlled air to the cooking chamber has an exhaust opening in its housing through which a portion of the temperature controlled air is exhausted from the system. In this arrangement, the oven further includes an ambient air intake opening in fluid communication with the blower whereby the blower draws airs through the intake opening to replace the exhausted air.

BRIEF DESCRIPTION OF THE DRAWINGS

FIG. 11 is a perspective view of an embodiment of an air delivery duct for the convection heat transfer system of the oven;

FIG. 12 is a perspective view of a preferred alternative embodiment of an air delivery duct for the convection heat transfer system of the oven;

FIG. 13A is a front view of a filter assembly for filtering air exiting the cooking chamber;

FIG. 13B is side view of the filter assembly of FIG. 13A;

FIG. 13C is schematic depiction of the accordion fold filter plate of the filter assembly of FIG. 13A;

FIG. 14 is a side view of a bracket for supporting the filter assembly of FIG. 13A on the side wall of the interior cooking chamber of the oven;

DETAILED DESCRIPTION OF THE INVENTION

The description of the invention provided below is made with reference to the drawings attached hereto. The drawings have been consecutively numbered as FIGS. 1–23.

Figure 1:
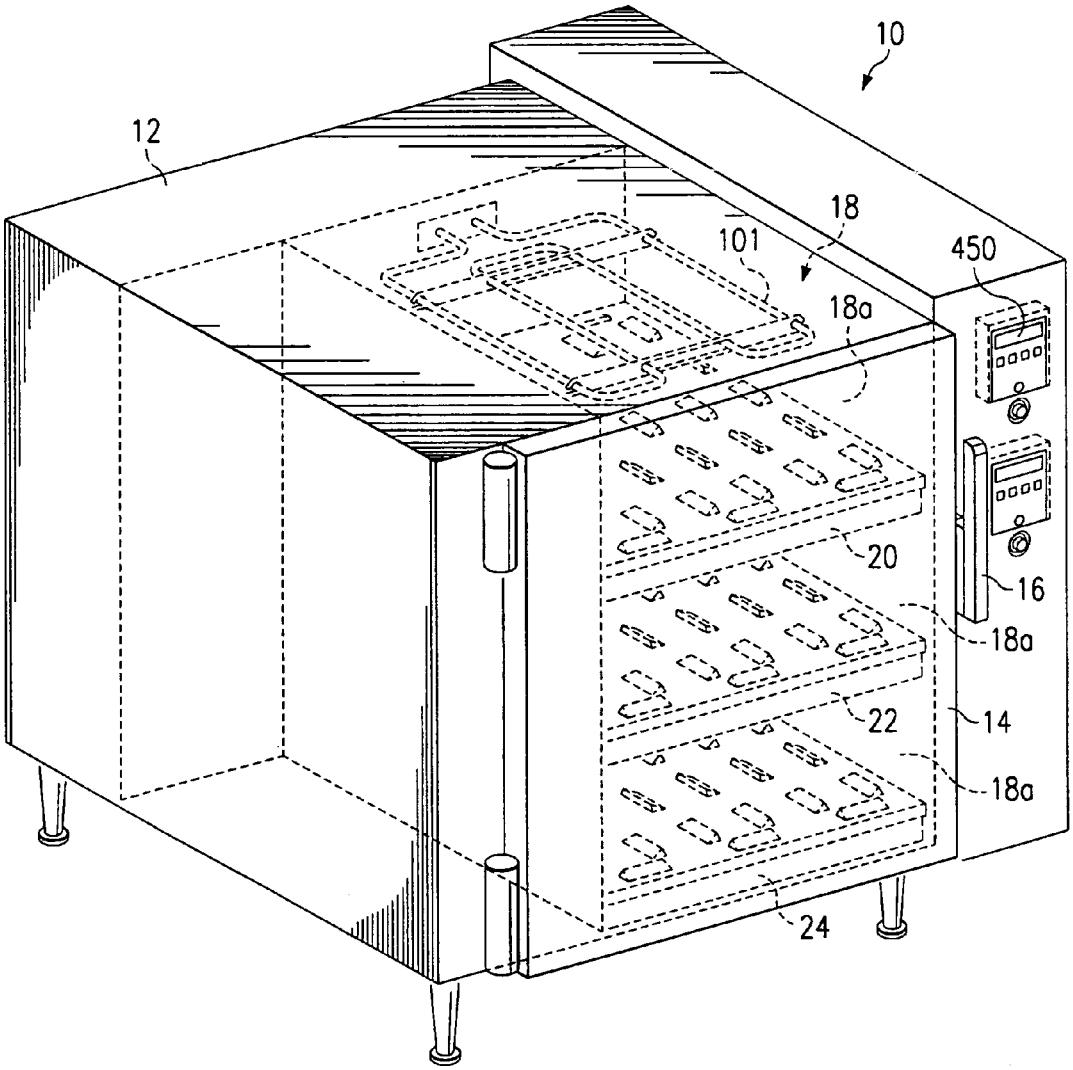
FIG. 1 is front view of the oven (three cavity configuration)

In FIG. 1, there is shown one embodiment of the oven 10 of the present invention. Oven 10 includes an exterior cabinet 12 defined by exterior side walls, exterior top and bottom walls and an exterior rear wall. Preferably said walls are constructed of a stainless steel material. Hingedly secured to the front of the oven is door 14 which permits food products to be placed in and out of the interior of the oven. A handle 16 with latching means is secured to door 14 to allow the door to be secured in a closed position during cooking. The door 14 is designed by known conventional means for preventing microwave leakage from the chamber 18 while the door is closed. Referring to FIGS. 2–4, 16–17 and 19, chamber 18 is defined by interior side walls 19 and 21, back wall 23, top wall 25 and bottom wall 27 (collectively the oven chamber interior walls). Preferably said oven chamber interior walls are constructed of a stainless steel material. As depicted in FIGS. 1 and 5 (three cavity oven) and FIGS. 16–17 and 19 (two cavity oven), chamber 18 further comprises a plurality of cooking cavities 18*a*.

Referring to the three-cavity oven of FIGS. 1–5, disposed within the chamber 18 of the oven are upper shelf 20, intermediate shelf 22 and lower shelf 24, preferably constructed of a stainless steel material. Shelves 20 and 22 are movably mounted within the oven chamber 18 and are positioned atop brackets to hold the shelves in position. Bottom shelf 24 can rest on the bottom of the oven chamber or, if desired, can rest on a bracket as well. Said brackets are generally shown by reference numeral 30 and are secured to the interior side walls of the oven cavity on opposite sides of the cavity walls. By providing removable shelves they can be more easily cleaned.

Figure 2:
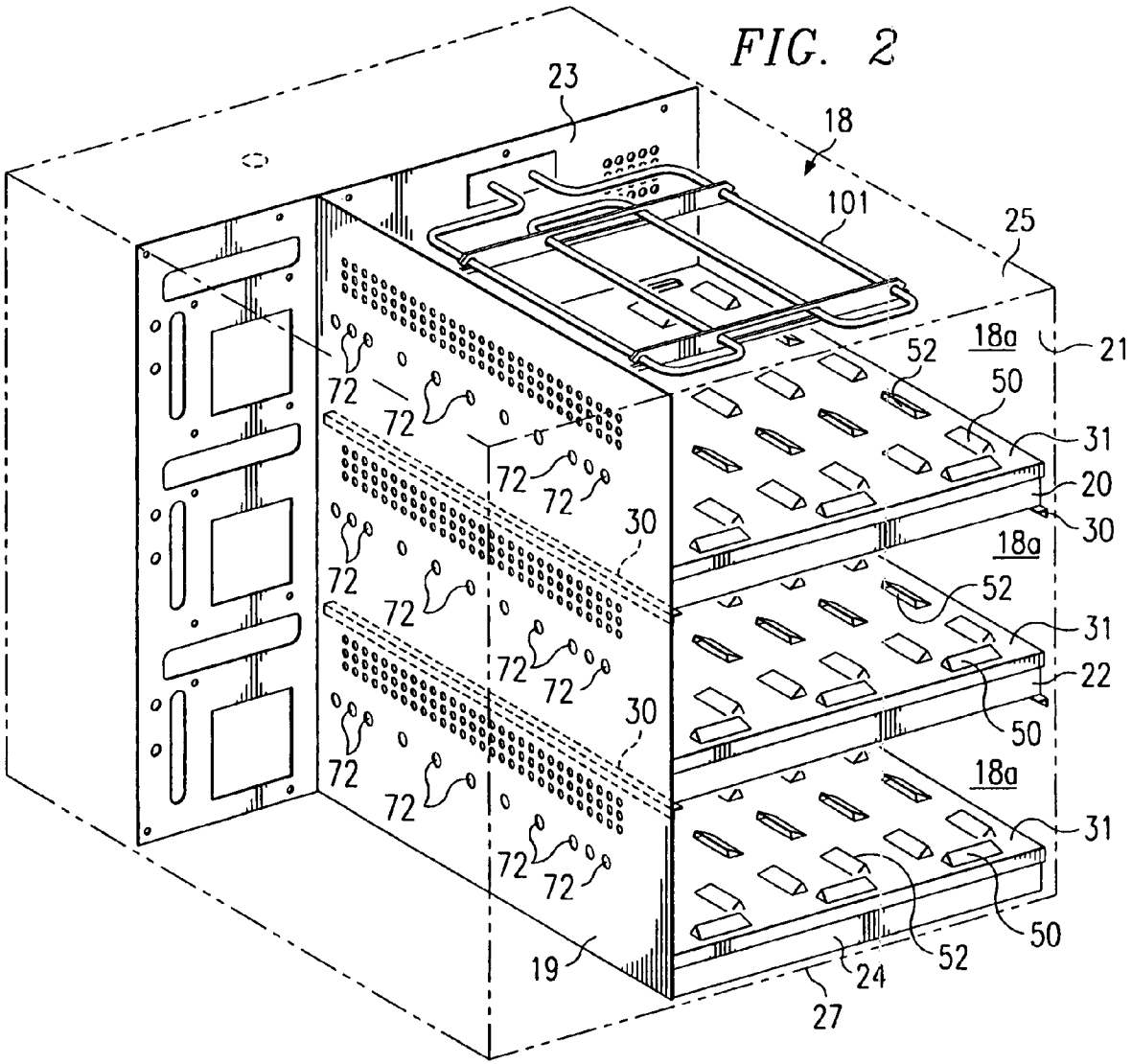
FIG. 2 is a front view of the interior cooking chamber of the oven (three cavity configuration)
Figure 8:
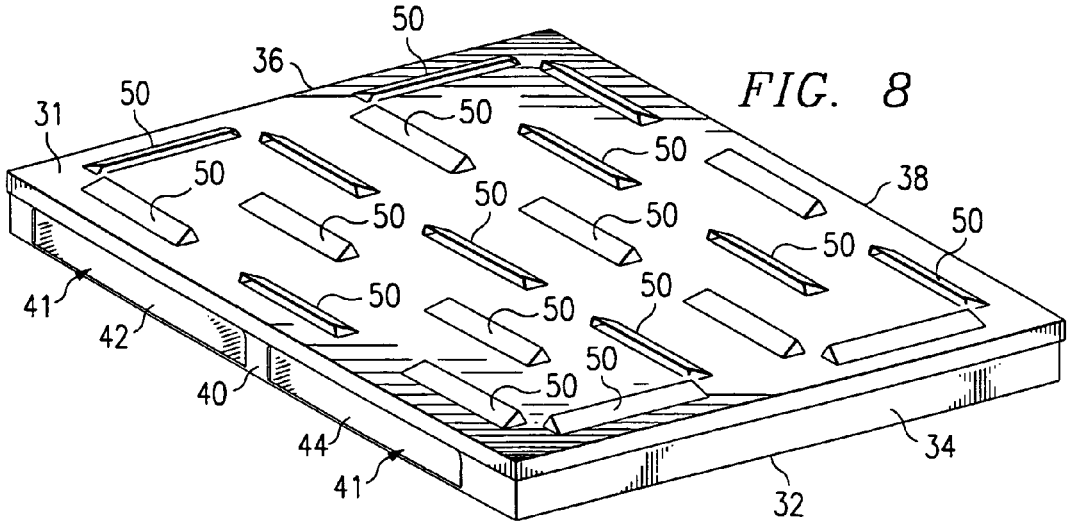
FIG. 8 is a perspective view of the food shelf which serves as a conduit through which temperature controlled air into the cooking chamber of the oven.

Referring to FIGS. 2, 5 and 8, the shelves 20, 22 and 24 shall be described in greater detail. Each shelf is designed to not only support a food product but is also designed as a conduit through which temperature-controlled (e.g. heated) gas (preferably air) passes and provides convection heating to food products within each oven cavity 18*a*. As shown in the above referenced figures, each shelf has a top portion 31, a bottom portion 32, side portions 34 and 36, rear portion 38 and front portion 40, defining shelf cavity 41. Front portion 40 is disposed within the chamber of the oven adjacent interior oven chamber side wall 19. Further, the front wall 40 of each shelf has openings 42 and 44 through which temperature controlled air can pass into the shelf cavity 41. After the temperature controlled air is disposed into the shelf cavity, the air then passes through openings 52 in louvers 50 which project from the top portion 31 of each shelf. The louvers 50 are positioned at spaced areas and permit air to exit via openings in the louvers in a direction substantially parallel to the top portion of the shelf, at least as it initially exits a louver 50. The openings on louvers 50 are best seen in FIGS. 5 and 8 and are represented by reference numeral 52. When temperature controlled gases exit openings 52 into the oven cavity, food products disposed within the oven cavity are heated via convective heat transfer. One advantage of the louvered openings projecting from the shelf is that when a pan or other food receptacle is placed on the shelf, heated air travels freely beneath the pan and between the louvers providing very effective convective heat transfer.

In an alternative embodiment of the shelf design, the louvers are inverted and do not project from the top of the shelf, but instead project into the shelf cavity. In this configuration the louvers act like scoops within the shelf cavity. While this configuration does not allow air to flow freely beneath a food tray disposed over the openings, a wire rack 900 (FIG. 10) may be placed on the shelf to lift the food receptacle (or food) from the top surface of the shelf, thereby providing satisfactory convection heat transfer.

Figure 9A:
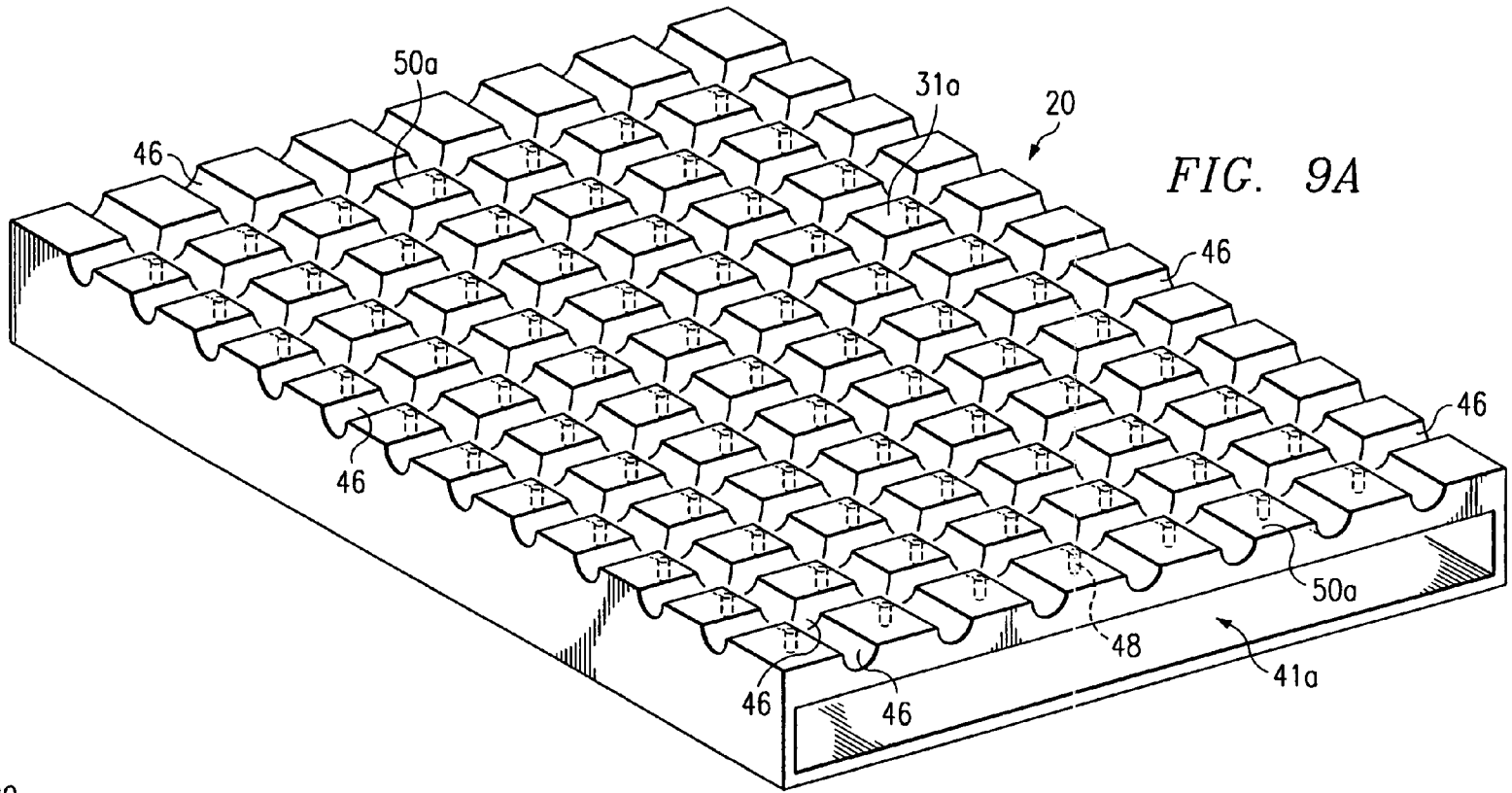
FIG. 9A is a perspective view of an alternative embodiment of the shelf.
Figure 9B:
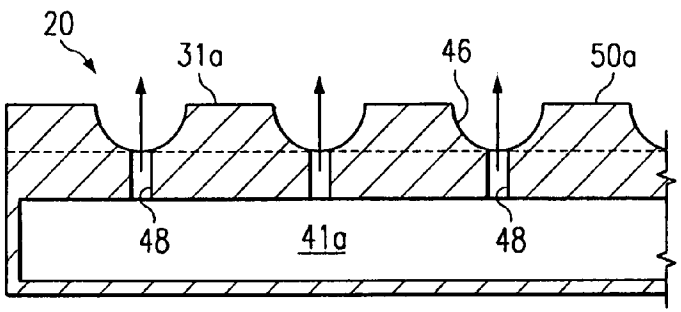
FIG. 9B is a cross section view of the alternative embodiment of the shelf depicted in FIG. 9A.

In yet another alternative embodiment of the shelf shown in FIGS. 9A and 9B, the top surface of the shelf 31*a* has vertically extending protrusions 50*a*, recessed areas or surfaces 46 and openings 48 disposed in the recesses areas. The arrows shown in FIG. 9B generally depict the direction of air travel into the shelf cavity 41*a* and through openings 48. Like the louver configuration (noninverted) described above, one advantage of the shelf design depicted in FIGS. 9A and 9B is that when a pan or other food receptacle is placed on the shelf, heated air travels freely beneath the pan and between the louvers providing very effective convective heat transfer.

Figure 4:
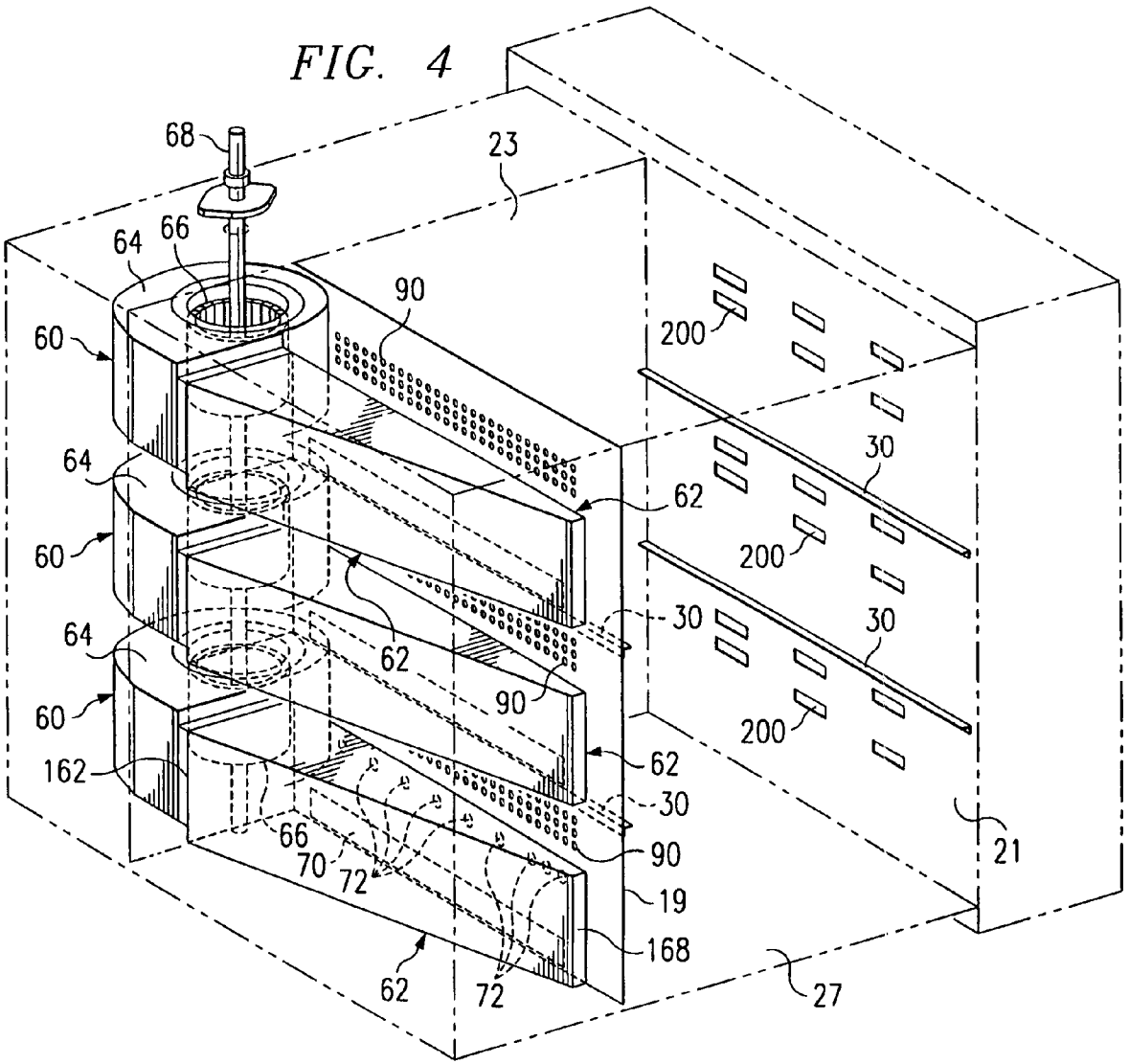
FIG. 4 is a front perspective view of the interior cooking chamber and portions of the convection heat transfer and microwave heat transfer systems of the oven (three cavity configuration)
Figure 5:
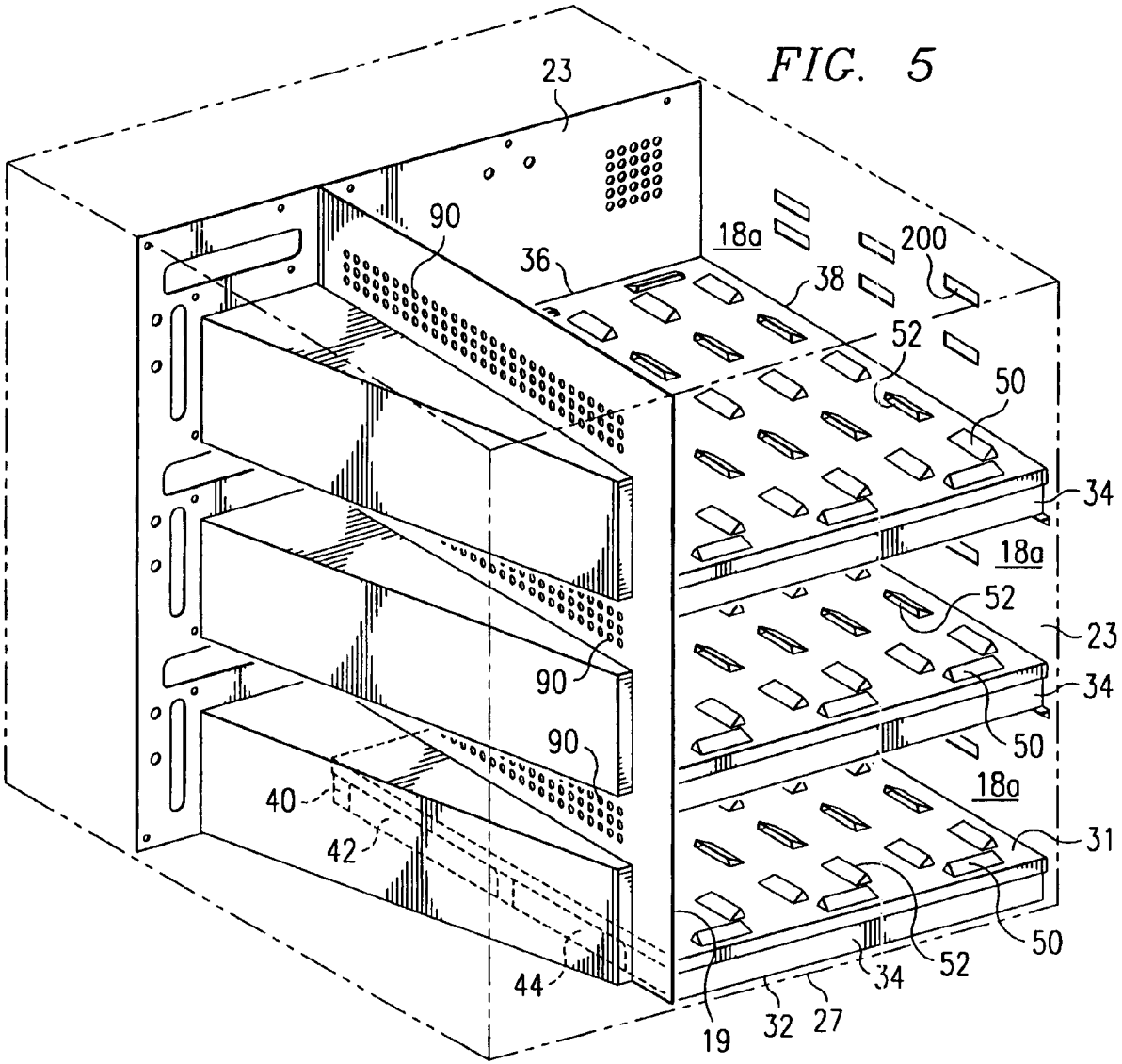
FIG. 5 is a front perspective view of the interior cooking chamber and portions of the convection heat transfer system of the oven (three cavity configuration), including the food product shelf.

Temperature controlled air is delivered into each shelf by blower assemblies 60 (FIG. 4). As shown in FIG. 4, each blower assembly 60 comprises a blower housing 64, a blower wheel 66 and a shaft 68 operably connected to a motor which rotates each blower wheel. In the preferred embodiment of the invention, each blower wheel is turned by a single axle 68 which is operably connected to a motor means. A 1/10 horsepower motor has been found to be adequate. A blower wheel of the forward inclined type has also been found to be adequate. Air is drawn into the blower housing and is disposed into tapered ducts 62 which, as shown, are disposed between the cabinet side wall and the oven chamber side wall 19.

In FIG. 4, specific reference numerals are provided only with respect to the tapered duct which is in fluid communication with the lower shelf. However, the features of the lower blower and duct assemblies are essentially identical to the middle and upper blower and duct assemblies and therefore descriptions for the latter are not repeated. As shown in FIG. 4, each tapered duct has a proximal end 162 and a distal end 168. An inlet opening is provided at proximal end where temperature controlled gas from blower 60 enters the duct (i.e., inlet opening 164 is in fluid communication with the blower assembly associated with the duct). Further, each tapered duct 62 has an elongated opening 70 at the bottom inward facing wall and also has a plurality of orifices 72. As shown in this embodiment, the orifices 72 and elongated opening 70 are formed in the side wall 19 of the oven chamber 18 (FIG. 12) with the remainder of the duct 62 being formed by two tapered side walls and a top wall. Temperature controlled gases entering each duct 62 exit through openings 72 into the respective oven cavities to heat the food product contained within said cavities. Further, as shown, a portion of the air entering each duct 62 also exits through opening 70 and flows respectively into the shelf cavities 18*a* of shelves 20, 22 and 24. In other words, each tapered duct feeds a separate shelf (20, 22, 24) and also feeds temperature controlled air through orifices 72 above each shelf (20, 22, 24). Accordingly, as described above, convective heat transfer is achieved by the present oven design through orifices located in the oven cavity side wall above each shelf and also through the shelves themselves through the louvers disposed on the top portion of each shelf. In an alternative arrangement, the oven would not include orifices 72 and therefore all heated gas would flow from ducts 62 into the shelf associated with the duct.

Referring to FIGS. 4–7, air return openings 90 are provided in side wall 19 within each cooking cavity 18*a* for the return of gas from each cooking cavity to blowers 60. By providing air return ports within each cavity 18*a*, each cavity can function as an independent convection oven, thereby allowing cooking of different foods at different temperatures and on different cycles. In an alternative embodiment of the invention (FIGS. 13A–C and 14), the air return openings 90 may be covered by a filter assembly 300 mounted to side wall 19 by a bracket 302 or other known means to prevent food particles, grease and other materials from escaping the cooking cavity through the return openings. A preferred filter assembly 300 is shown in FIGS. 13A–C and 14 and comprises a filter frame 304 which supports a perforated metal plate 306 that is folded in an accordion fashion thereby providing a greater surface area over which return air passes before exiting the cooking chamber through the return openings.

Figure 7:
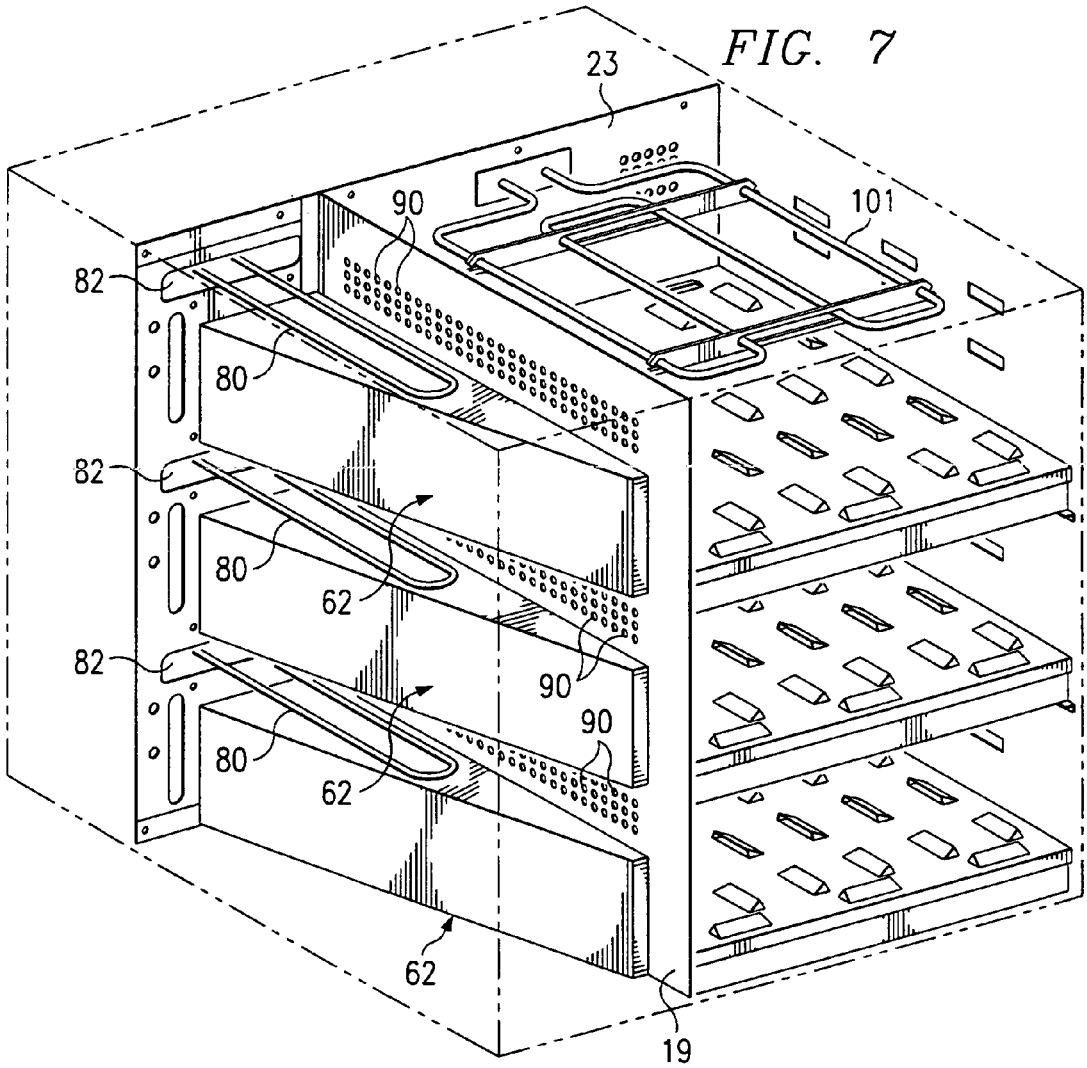
FIG. 7 is a left side view of the oven with the left panel of the exterior cabinet removed to show portions of the convection heating system of the oven (three cavity configuration)

The temperature of the circulated air or gas can be controlled by any known means. One suitable means to heat and control the temperature of the air is by well known electric heating rods 80 (i.e., Calrod) (FIG. 7) or "gas burner" (not shown). Heating rods 80 can be disposed in any suitable location. In the preferred embodiment, heat rods are placed as shown in FIG. 7 in the return air path for the oven. FIG. 7 shows just one heating rod placed between the upper and middle ducts 62 in the area between the exterior cabinet side wall and the cavity side wall 19. Preferably, a heating element is placed above each duct 62 through the openings 82 shown in FIG. 7.

As it relates to the tapered duct design, duct 62 may have a constant taper from proximal end 162 to distal end 168 as shown in FIGS. 3–5 and 7 or may have multiple degrees of taper as shown by the dashed lines in FIG. 11. As shown in FIG. 11 and denoted by the cross hatched lines, duct 62 may have a dual taper configuration, which has been found to provide even air flow from the orifices along the length of the duct. More particularly, in the dual taper configuration of duct 62, said duct has a first horizontal tapered portion 160 adjacent proximal end 162 and inlet opening 164 (i.e., the opening where air from the blower enters the duct) and a second horizontal tapered portion 166 adjacent the distal end 168. As shown, the first horizontal tapered portion 160 has a greater angle of taper than the second horizontal tapered portion 166 which has a lower slope. Preferably, the first horizontal tapered portion 160 extends approximately one-quarter to one-half of the length of the duct. The degree of taper in the first and second horizontal tapered portions may vary. Preferably, the first horizontal tapered portion tapers down 1 inch for every 1 to 3 inches of length and the second horizontal tapered portion tapers 1 inch for every 7 to 16 inches of length. By providing a dual taper, it has been found that the air is distributed more evenly along the length of the duct from proximal end 162 to distal end 168. In a most preferred embodiment of the duct 62 shown in FIG. 12, said duct not only includes the dual taper horizontally along its length described above, but also includes a vertically tapered portion 170 adjacent proximal end 162 to further enhance air flow into the duct and even distribution of heated air into the oven chamber along the length of the duct.

After the temperature controlled air enters the oven cavity 18*a* through the above-described orifices 72 (optionally) and shelves, air is returned to the blower housing through return openings 90 in the oven cavity side wall 19 (i.e, the cavity wall adjacent each duct 62) (see FIGS. 2–5). The air returning through openings 90 is heated by heating element 80 before entering the blower housing where the heated air is recirculated into the oven cavity through the ducts 62.

Figure 6:
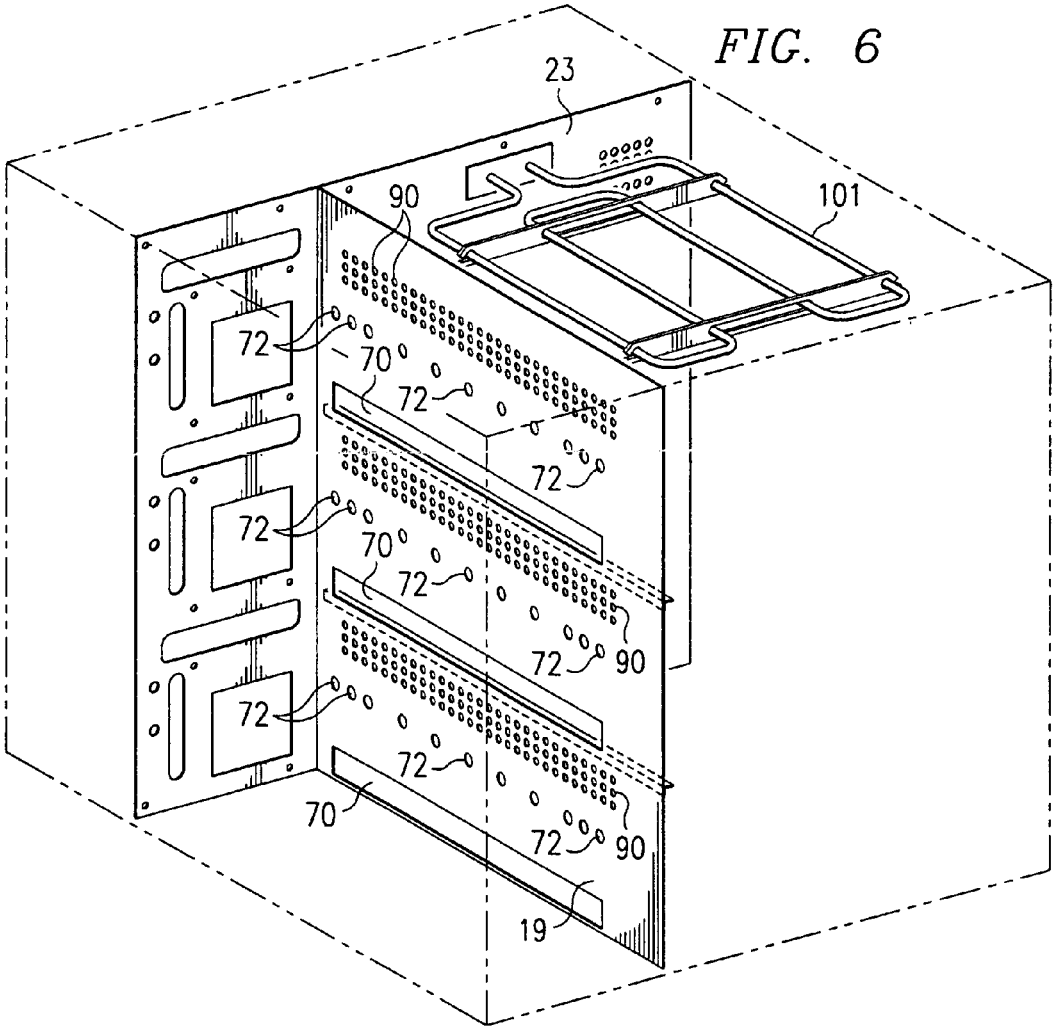
FIG. 6 is a view of the interior cooking chamber depicting the electric heating element within the cooking chamber.
Figure 10:
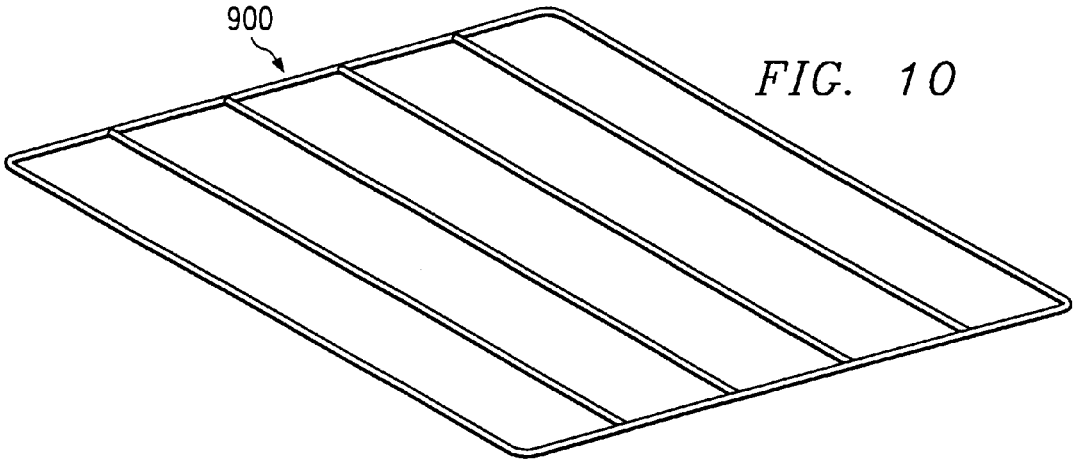
FIG. 10 is a perspective view of a product support rack.

Optionally, an electric heating element 101 (e.g., Calrod heating elements) may also be disposed adjacent the top of the oven cavity so as to provide a means for broiling food products disposed on the upper shelf (see FIGS. 1, 2 and 6).

The present oven also provides means for heating food product via microwave energy. In one embodiment of the invention shown in FIGS. 2 and 3, microwaves are disposed into the oven cavity through microwave openings 200 formed in the side wall 21 of the oven cavity. Side wall 21 is disposed opposite of oven cavity side wall 19. As shown in the preferred embodiment, there are three series of openings 200, each being served by a separate magnetron assembly 210. The type (i.e. power) of magnetron used is a matter of choice and is based on well known selection factors. Use of 2450 MHz magnetrons were found suitable in the embodiment shown in FIGS. 16–18.

Figure 3:
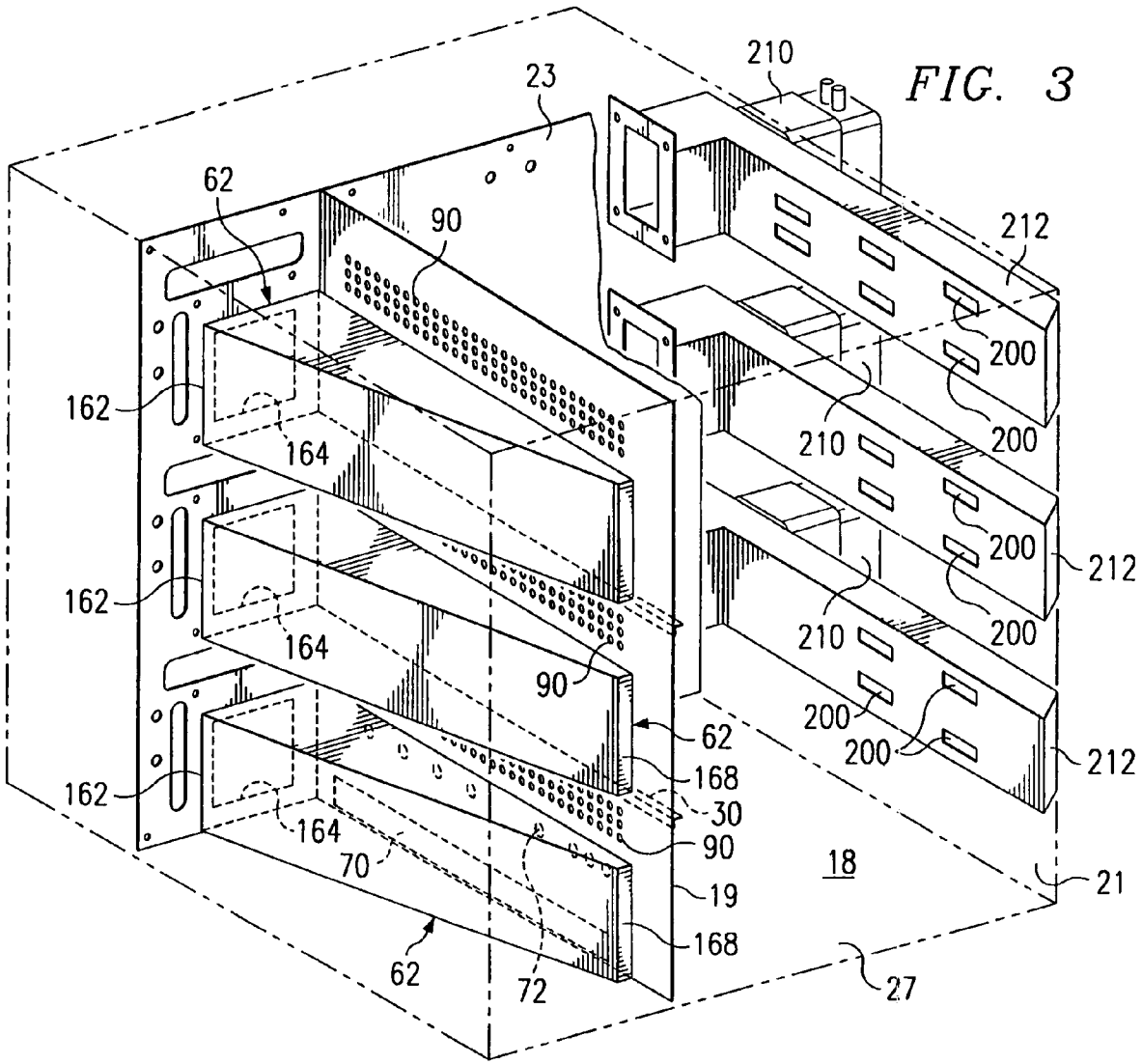
FIG. 3 is a front perspective view of the interior cooking chamber and portions of the convection heat transfer and microwave heat transfer systems of the oven (three cavity configuration)
Figure 15:
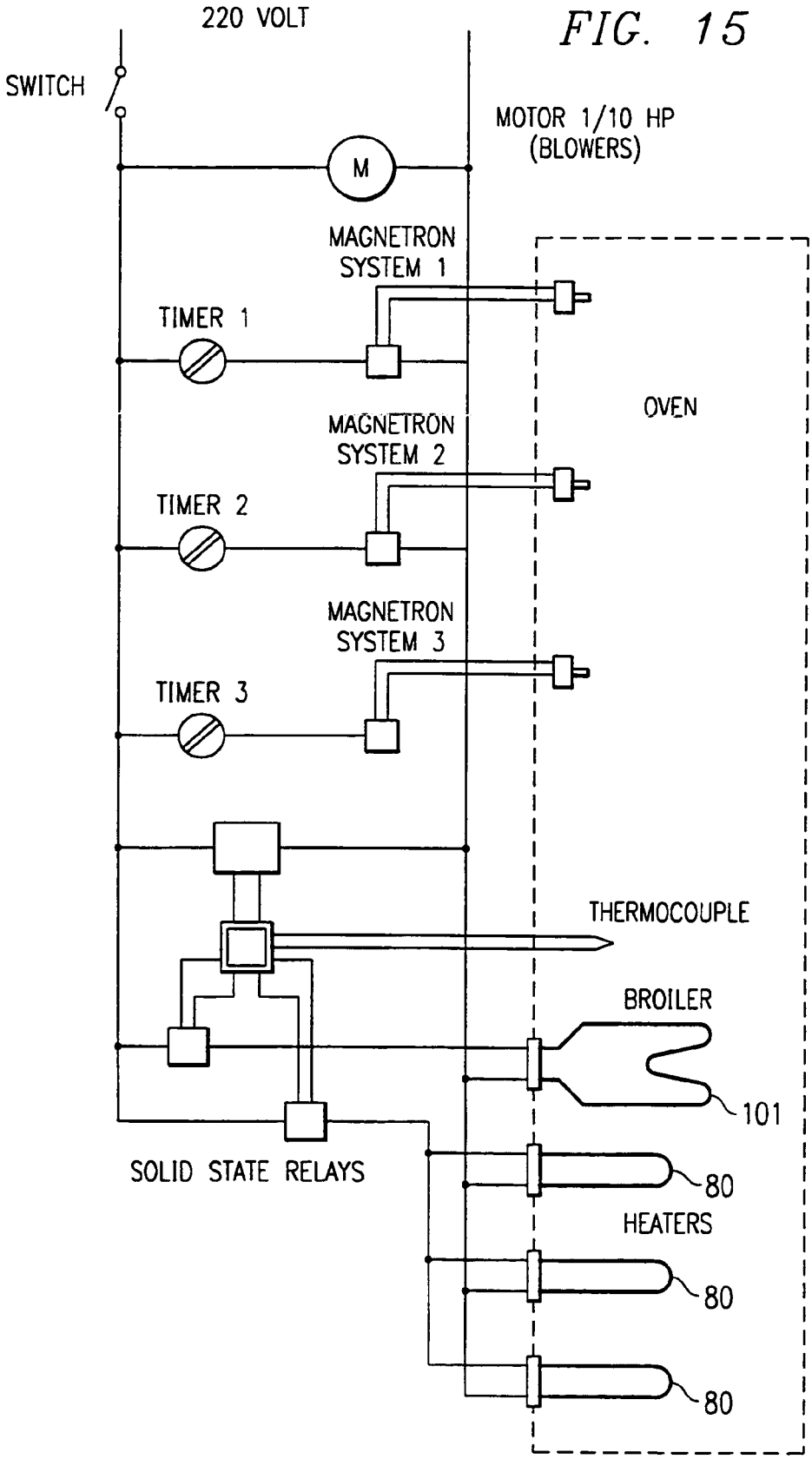
FIG. 15 is schematic depiction of a control system for the oven of the present invention (three cavity configuration)

In the embodiment shown in FIGS. 2 and 3, each magnetron 210 feeds microwaves into and through a conduit 212 associated with the particular magnetron assembly and through the openings 200 and into the oven cavity. The openings 200 and conduit structure 212 are arranged such that a more uniform dispensing of microwave is provided within the oven cavity. A preferred configuration for the openings 200 is shown in the figures. Other configurations may also be determined and will vary according to the design and dimensions of the cooking cavity. As shown in the figures, each cavity 18*a* has its own independent microwave source (i.e., magnetrons assemblies). Thus, heating of food products disposed in different cavities can be provided at different rates and on different cycles by separately controlling each magnetron. A schematic representation of the heating controls for the embodiment of FIGS. 1–5 is shown in FIG. 15.

Figure 16:
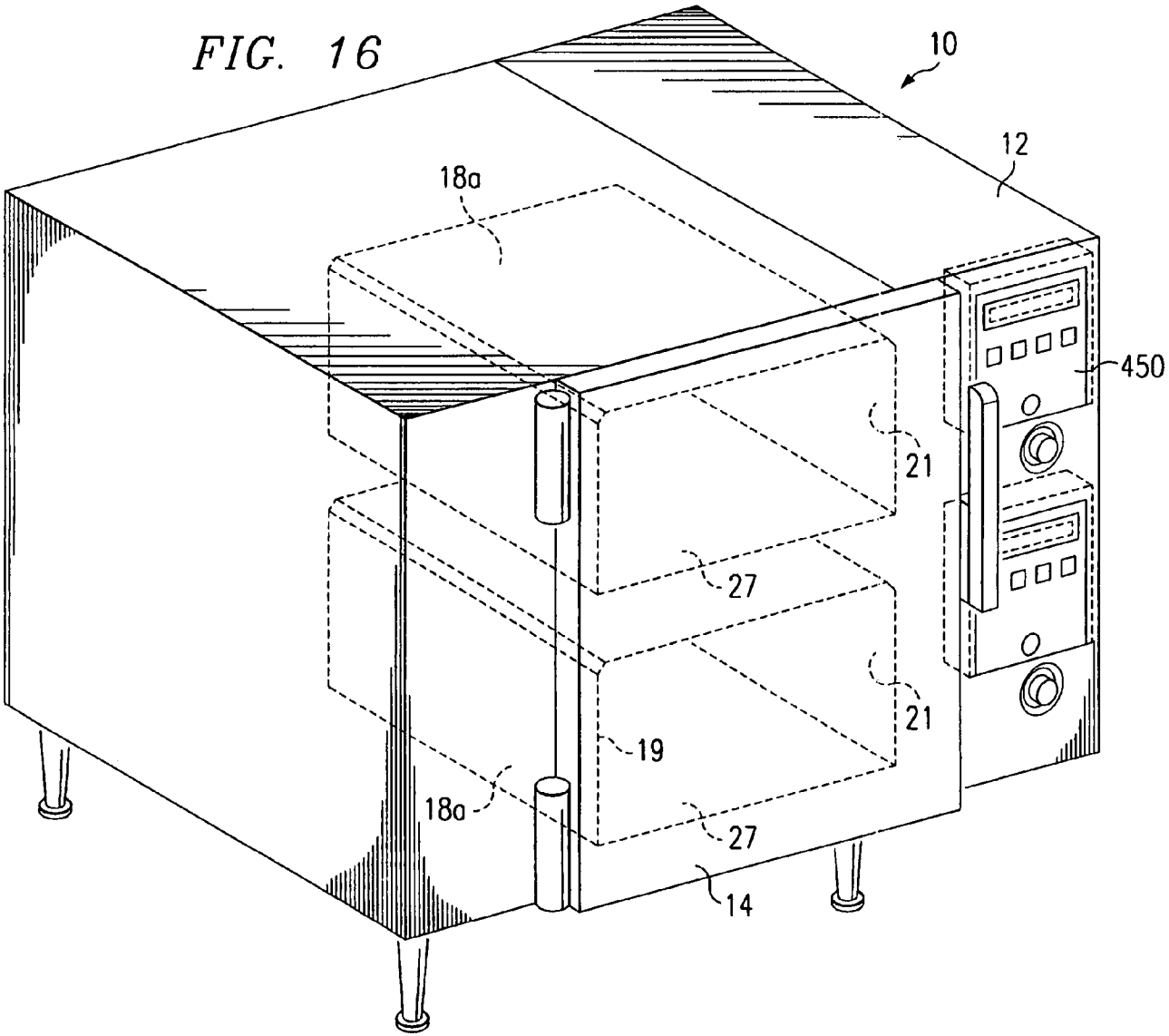
FIG. 16 is a perspective view a two cavity configuration of the oven.
Figure 17:
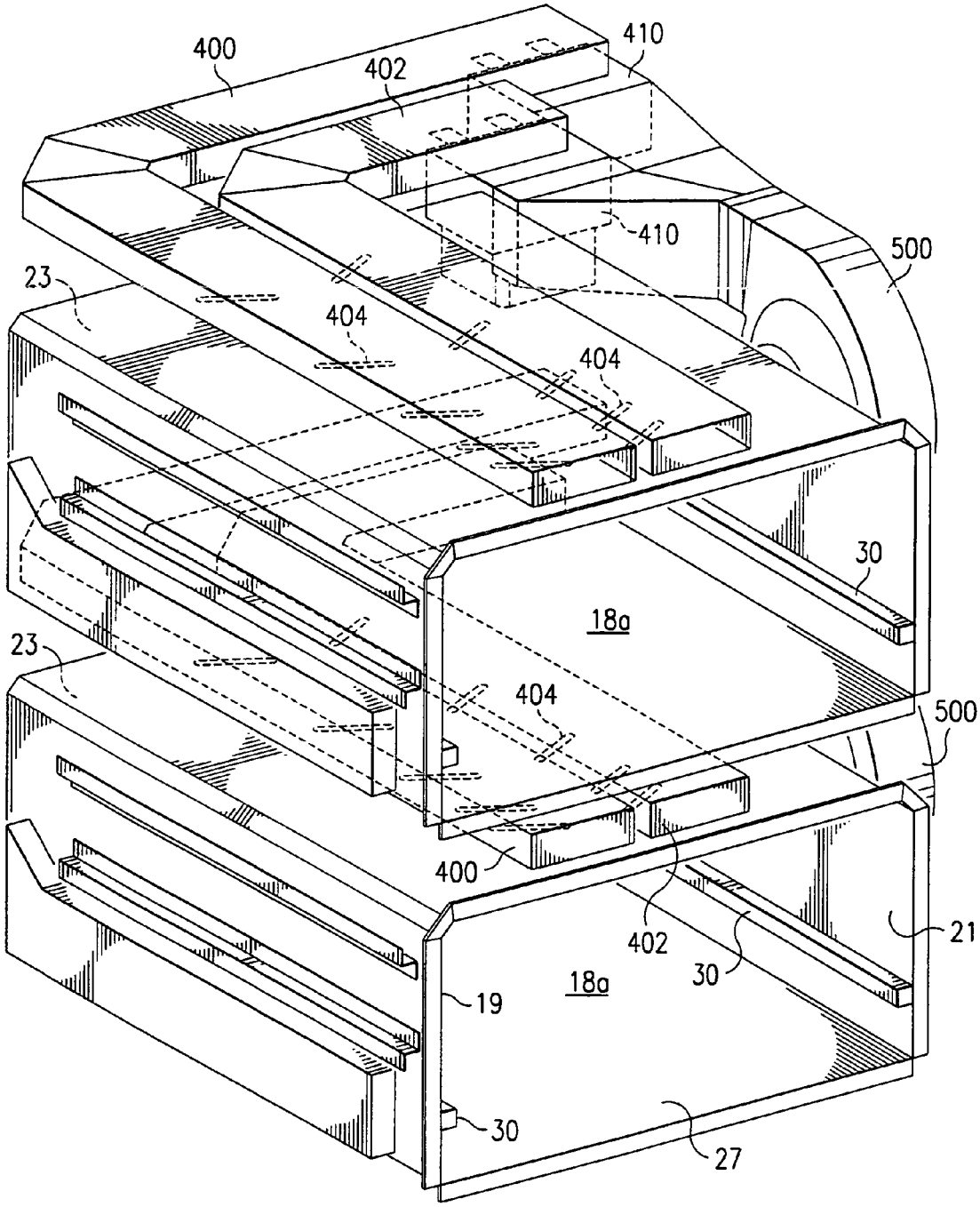
FIG. 17 is a partial perspective view of the interior cooking chamber and microwave heating system for the oven (two cavity configuration)
Figure 18:
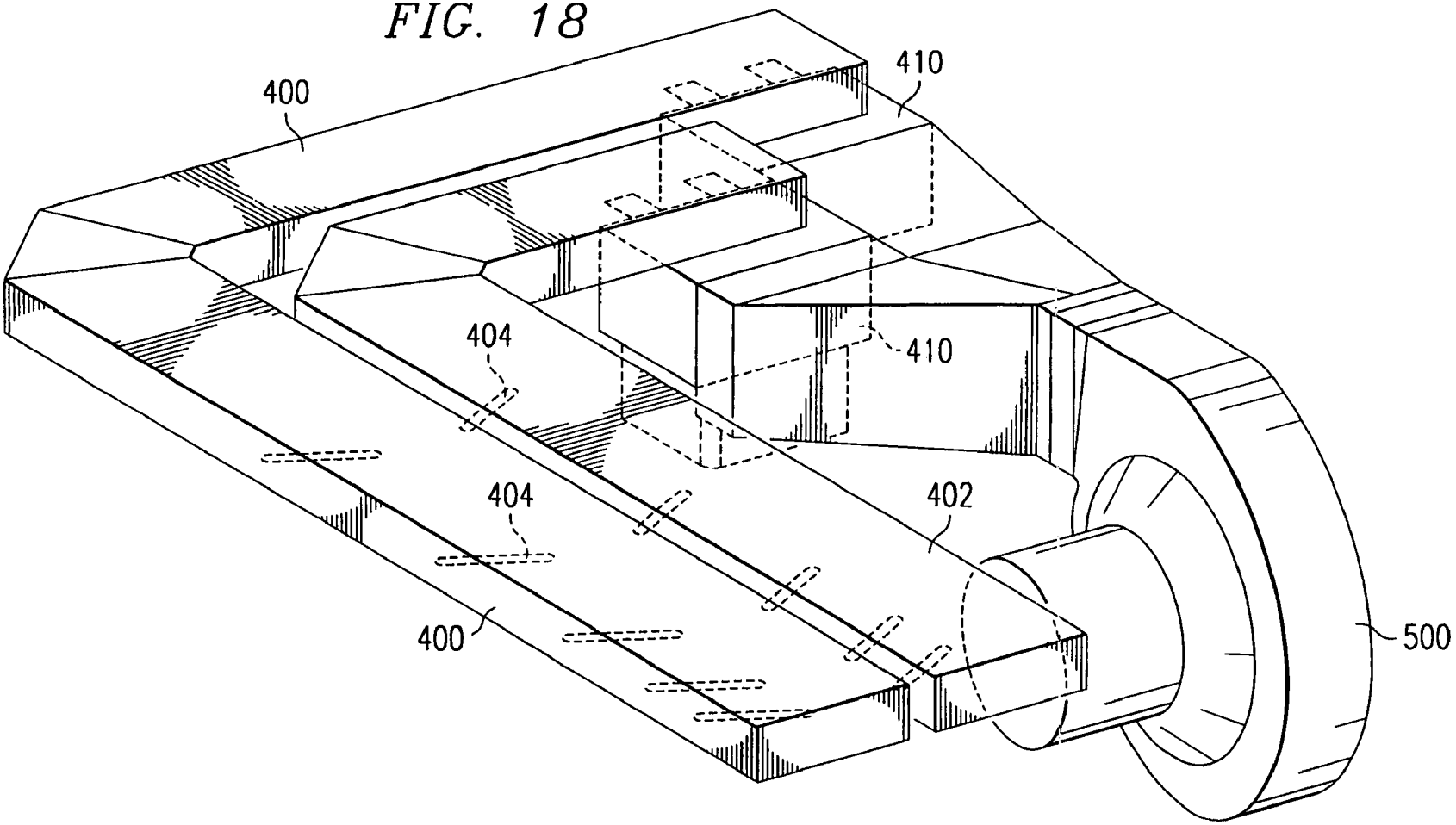
FIG. 18 is a perspective view of the microwave heating system for the oven (two cavity configuration)

In a preferred embodiment of the invention shown in FIGS. 16–20 (two cavity design), microwave energy from magnetrons 410 is fed into each oven cavity 18*a* through a pair of wave guides 400, 402 (i.e., conduits) disposed above each cavity. Thus, each cavity 18*a* has its own independent microwave source. Each wave guide includes a plurality of openings 404, preferably slots, through which the microwaves travel into the cooking cavity. The slots 404 are spaced to provide substantially even microwave distribution along the length of the wave guide. Specifically, the slots are spaced approximately at multiples of the calculated minima or maxima for the microwaves generated by the microwave source, i.e. magnetron. The minima and maxima for a particular wave guide and magnetron are calculated by known means. Microwave maxima and minima for various wave guide designs and microwave frequencies also can be readily determined by reference to tables published by magnetron suppliers, such as Continental Microwave & Tool Co., Inc, Hampton, N.H. As shown, slots 404 are preferably disposed at angles in relation to the length of wave guides which run generally from the back towards the front of each cavity. Further, as shown in FIGS. 17–18, blowers assemblies 500 are preferably provided to cool the magnetrons 410 during operation.

In a preferred embodiment of the invention reciprocating reflective stirrers 600 are disposed above the heating elements at the top of heating chamber 18 for reflecting heat from the heating element toward the shelf below. Preferably the stirrers are made of a material that is also microwave reflective so that enhanced stirring of microwaves is achieved, thereby promoting evenness of cooking. A suitable stirrer material is stainless steel. As shown, the reflective stirrer 600 is operably connected to bearing 602 which is moved by link 604, which in turn is connected to a drive link 606 driven by motor 608.

Figure 19:
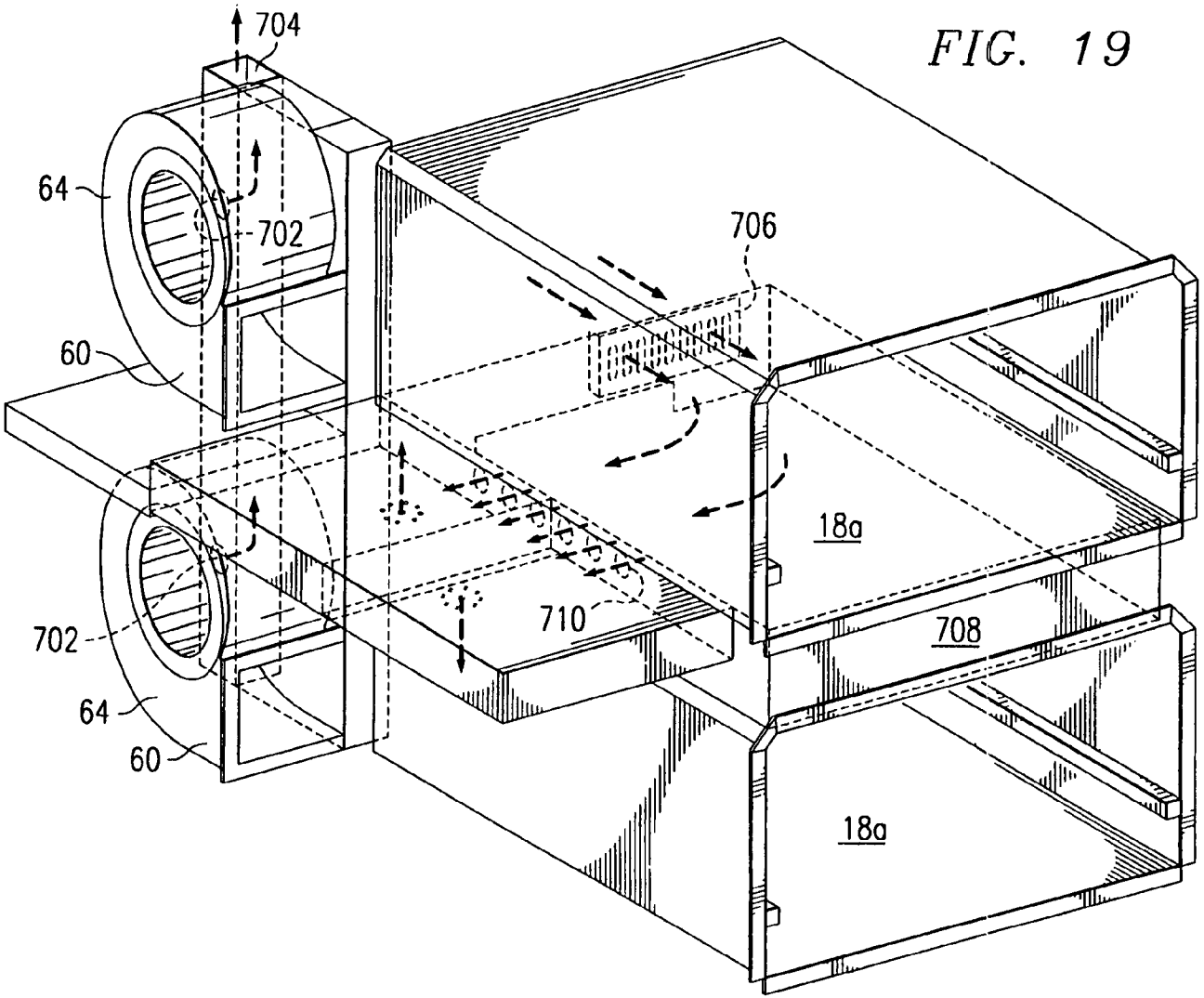
FIG. 19 is a partial perspective view of the cooking chamber and oven configuration with partial exhaust of temperature controlled air stream.
Figure 20:
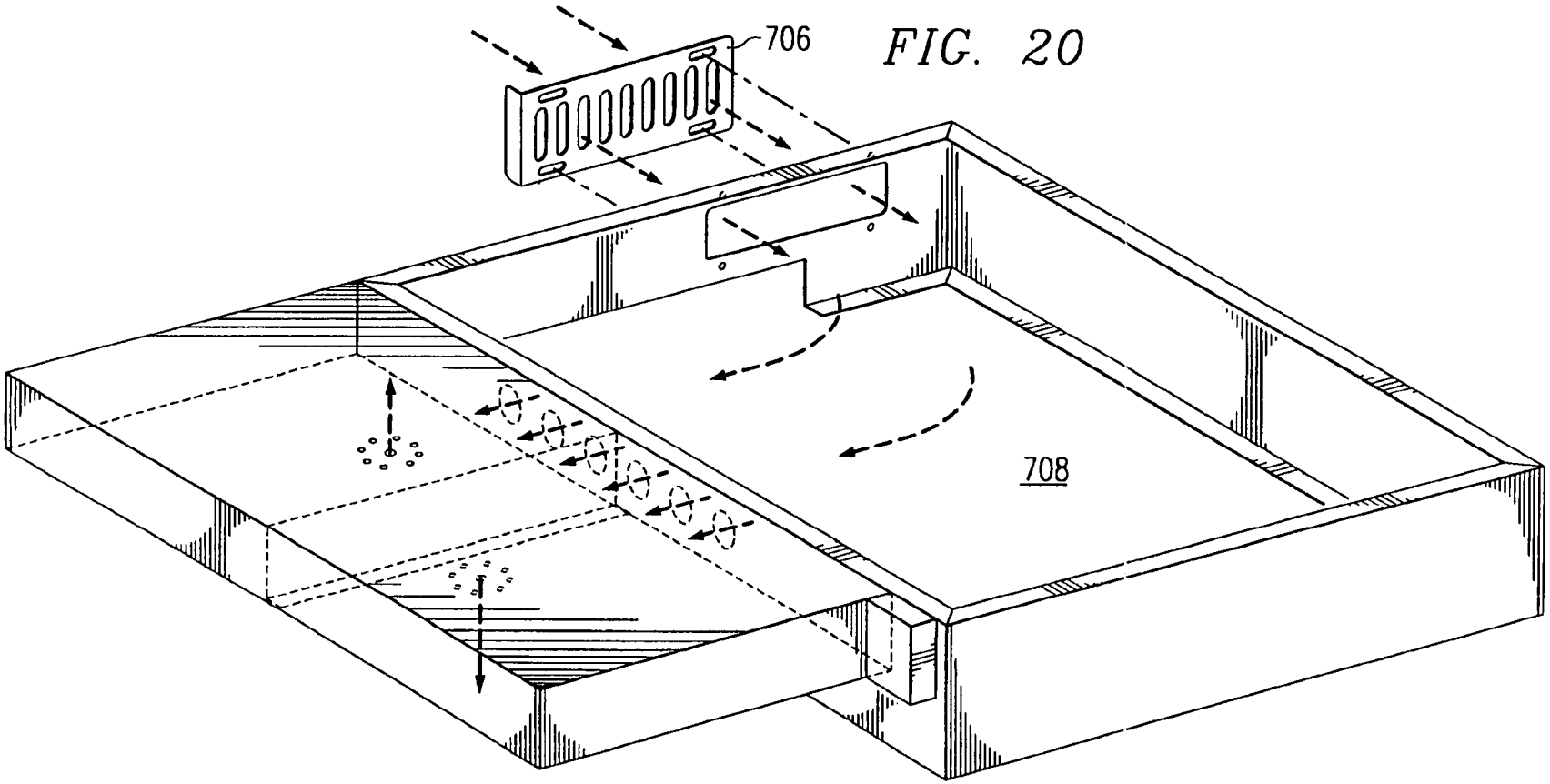
FIG. 20 is a partial perspective view of the ambient air intake and partition chamber aspects of a preferred embodiment of the two cavity configuration of the oven.
Figure 21:
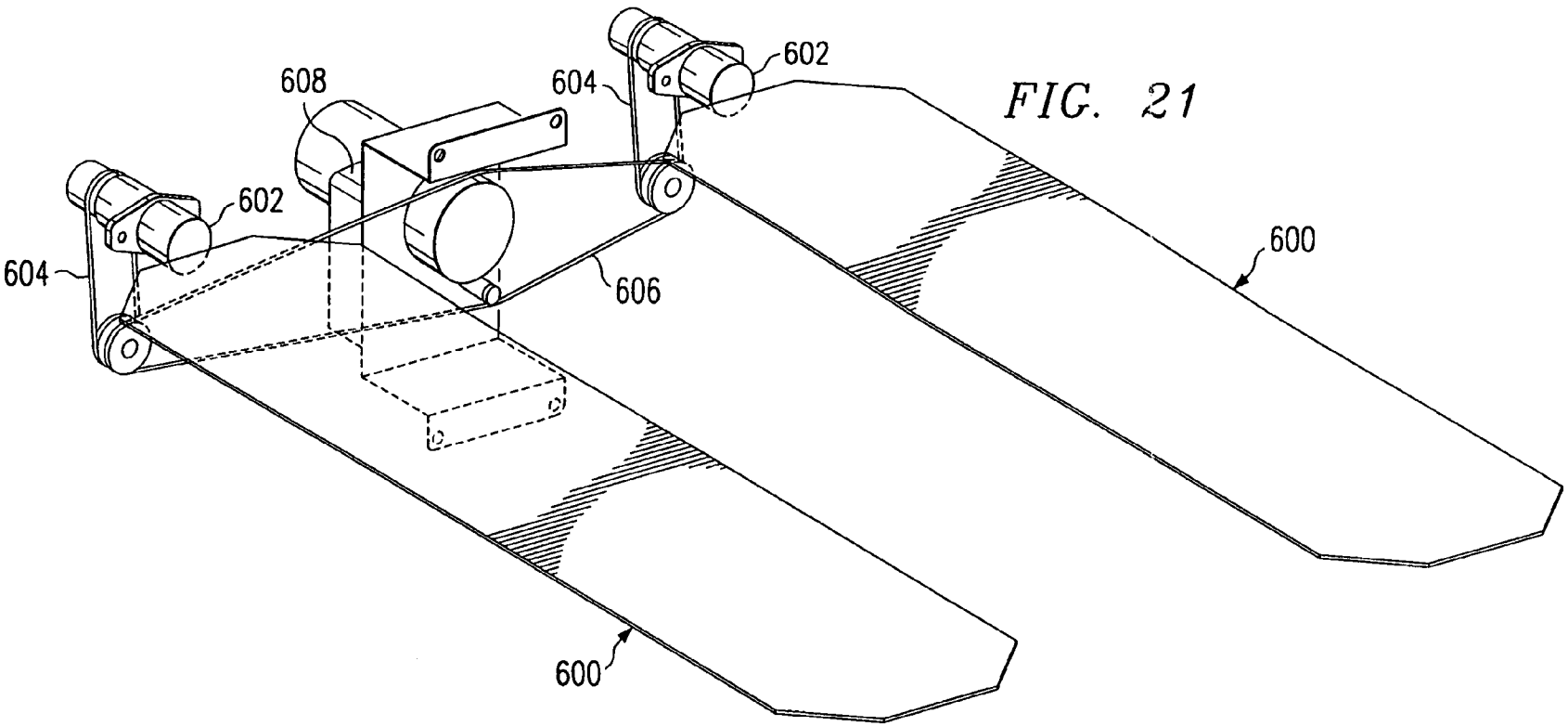
FIG. 21 is a perspective view of the reflective stirrer of the present invention.

In the embodiment of the invention shown in FIGS. 16–20, it should be noted that chamber 18 comprises two cooking cavities 18*a* and that two doors 700 are used to seal the oven. Another feature of an embodiment of the invention provides for the exhausting of a portion of the temperature controlled cooking air from the blower housing. Referring to FIGS. 17–19, there is shown a exhaust opening 702 in blower housing 64 through which a portion of the temperature controlled gas is exhausted from the oven via stack (or conduit) 704. The exhausting of air from the system induces ambient air to be drawn through intake opening 706 disposed at the back of the oven. Ambient air is then drawn into partition chamber 708 disposed between the upper and lower cavities 18*a*. Air from partition chamber 708 is then drawn through openings 710 to both the upper and lower blower assemblies 60 which are in fluid communication with the partition chamber. Exhaust air flow and "make up" ambient air flow into the system is depicted by the arrows in FIGS. 19 and 20. The location of the partition chamber between the cooking cavities of the oven is particularly advantageous since the heat from the cooking cavities heats the air in the partition chamber, thus acting as a heat exchanger to preheat ambient air.

FIGS. 1 and 16 generally depict the control panel (or controller) 450 for the embodiments described herein. Preferably, the controller 450 has the capability to control microwave heating power and cook cycle times, and is capable of being programmed for particular food cooking applications. Likewise, it also is preferable that the controller 450 control the convective heat transfer aspects of the invention (e.g., blowers 60 and heating elements) and the reflective stirrers described above.

The present invention is not limited to the examples illustrated above, as it is understood that one ordinarily skilled in the art would be able to utilize substitutes and equivalents without departing from the present invention.

The invention claimed is:

1. An oven comprising:

a cooking cavity defined by a door and a plurality of walls; said cooking cavity having a length, width and height;

a first microwave source for producing microwaves;

a first wave guide having a length which traverses said length or said width of said cooking cavity; said first wave guide providing a conduit through which said microwaves travel; said first wave guide having a plurality of slots intersecting the centerline of its length; said slots spaced appropriately at multiples of the calculated minima or maxima for the microwaves generated by said microwave source; and through which said microwaves can pass into said cooking cavity.

2. The oven of claim 1 further comprising:

a second microwave source and a second wave guide through which microwaves travel, said second wave guide having a length which traverses said length or said width of said cooking cavity; said second wave guide providing a conduit through which microwaves from said second microwave source travel; said second wave guide having a plurality of openings along its length through which said microwaves can pass into said cooking cavity.

3. The oven of claim 2 further comprising a blower that circulates heated gas into said cooking cavity.

4. An oven comprising:

at least one cooking cavity;

a blower;

a shelf disposed within each said cooking cavity and defining the bottom of said cooking cavity, each said shelf having an inlet opening and cavity in fluid communication with said blower, each said shelf having at least one opening in fluid communication with said cooking cavity in which it is disposed through which temperature controlled gas can flow into said cooking cavity;

at least one air return opening in each said cooking cavity in fluid communication with said blower for return of said temperature controlled gas to said blower; and a microwave heating source and wave guide through which microwaves travel, said wave guide having a plurality of openings through which said microwaves can pass into at lease one cooking cavity, wherein said microwaves traveling in said wave guide have a wavelength and predetermined minima and maxima, said openings in said wave guide being positioned to substantially correspond with said minima or maxima.

5. The oven of claim 4 further comprising a heating element within at least one cooking cavity.

6. The oven of claim 5 further comprising a movable stirrer positioned above said heating element, said stirrer being capable of reflecting heat from said heating element toward said shelf in said cooking cavity.

7. The oven of claim 6 wherein said stirrer is constructed of a microwave reflective material.

8. The oven of claim 4 wherein said shelf has a top surface and a plurality of louvers protruding from said top surface for supporting a food receptacle above said top surface.

9. The oven of claim 8 wherein said at least one opening in said shelf is configured to project said temperature controlled gas in a direction that is substantially parallel to said top surface of said shelf.

10. The oven of claim 4 further comprising a filter adjacent said air return opening for filtering entrained materials from said temperature controlled gas.

11. An oven comprising:

a first cooking cavity and a second cooking cavity;

a blower;

a shelf disposed within each said cooking cavity and defining the bottom of said cooking cavity, each said shelf having an inlet opening and cavity in fluid communication with said blower, each said shelf having at least one opening in fluid communication with said cooking cavity in which it is disposed through which temperature controlled gas can flow into said cooking cavity;

at least one air return opening in each said cooking cavity in fluid communication with said blower for return of said temperature controlled gas to said blower;

a first microwave source and a first wave guide through which microwaves travel, said first wave guide having a plurality of openings through which said microwaves can pass into said first cooking cavity; and a second microwave source and a second wave guide through which microwaves travel, said second wave guide having a plurality of openings through which said microwaves can pass into said second cooking cavity, wherein said microwaves traveling in said first wave guide have a wavelength and predetermined minima and maxima, said openings in said first wave guide being positioned to substantially correspond with said minima or maxima; and wherein said microwaves traveling in said second wave guide have a wavelength and predetermined minima and maxima, said openings in said second wave guide being positioned to substantially correspond with said minima or maxima.

12. The oven of claim 11 wherein said blower comprises a blower housing having an exhaust opening through which a portion of said temperature controlled air is exhausted from said blower housing, said oven further comprising an ambient air intake opening in fluid communication with a chamber disposed between said first and second cooking cavities, said chamber being in fluid communication with said blower wherein said blower draws air from said chamber.

13. An oven comprising:

a first cooking cavity and a second cooking cavity;

a blower;

a shelf disposed within each cooking cavity and defining the bottom of said cooking cavity, each said shelf having an inlet opening and cavity in fluid communication with said blower, each said shelf having at least one opening in fluid communication with said cooking cavity in which it is disposed through which temperature controlled gas can flow into said cooking cavity;

at least one air return opening in each said cooking cavity in fluid communication with said blower for return of said temperature controlled gas to said blower;

a first microwave source and a first wave guide through which microwaves travel, said first wave guide having a plurality of openings through which said microwaves can pass into said first cooking cavity;

a second microwave source and a second wave guide through which microwaves travel, said second wave guide having a plurality of openings through which said microwaves can pass into said second cooking cavity;

a third microwave source and a third wave guide through which microwaves travel, said third wave guide having a plurality of openings through which said microwaves can pass into said first cooking cavity; and a fourth microwave source and a fourth wave guide through which microwaves travel, said fourth wave guide having a plurality of openings through which said microwaves can pass into said second cooking cavity, wherein said microwaves traveling in said first wave guide have a wavelength and predetermined minima and maxima, said openings in said first wave guide being positioned to substantially correspond with said minima or maxima;

wherein said microwaves traveling in said second wave guide have a wavelength and predetermined minima and maxima, said openings in said second wave guide being positioned to substantially correspond with said minima or maxima;

wherein said microwaves traveling in said third wave guide have a wavelength and predetermined minima and maxima, said openings in said third wave guide being positioned to substantially correspond with said minima or maxima; and wherein said microwaves traveling in said fourth wave guide have a wavelength and predetermined minima and maxima, said openings in said fourth wave guide being positioned to substantially correspond with said minima or maxima.

14. A thermal treatment apparatus comprising:

at least one thermal treatment cavity;

a blower in fluid communication with each said cavity for circulating temperature controlled gas in said at least one cavity;

a shelf disposed within said at least one thermal treatment cavity, said shelf comprising (a) a top portion having an upwardly facing top surface; said top portion having a plurality of openings through which gas circulated by said blower may pass; and (b) a cavity beneath said top portion defined by said shelf through which gas circulated by said blower may pass;

at least one air return path in each said cavity in fluid communication with said blower for return of said temperature controlled gas to said blower; and a microwave source and wave guide through which microwaves travel, said wave guide having a plurality of openings through which said microwaves can pass into said cavity, wherein said microwaves traveling in said wave guide have a wavelength and predetermined minima and maxima, said openings in said wave guide being positioned to substantially correspond with said minima or maxima.

15. The thermal treatment apparatus of claim 14 wherein said openings are in the form of louvers protruding from said top surface for supporting a food receptacle.

* * * * *